United States Patent [19]

Ffooks

[11] 3,974,935

[45] Aug. 17, 1976

[54] STORAGE CONTAINERS FOR LIQUEFIED GASES

[75] Inventor: Roger Cambridge Ffooks, Billingshurst, England

[73] Assignee: Conch Lng (General Partnership), Moorsetown, N.J.

[22] Filed: Sept. 6, 1974

[21] Appl. No.: 503,655

[30] Foreign Application Priority Data

Sept. 8, 1973 United Kingdom ..... 42315/73

[52] U.S. Cl. ..... 220/9 LG; 62/45; 220/15

[51] Int. Cl.[2] ..... B65D 25/18

[58] Field of Search ..... 62/45; 114/74 A; 220/9 LG, 15; 52/480, 481

[56] References Cited

UNITED STATES PATENTS

| | | | |
|---|---|---|---|
| 3,490,639 | 6/1970 | Gibson | 220/9 LG |
| 3,581,931 | 6/1971 | Yamamoto | 220/9 LG |
| 3,692,205 | 9/1972 | Cowles et al. | 220/9 LG |
| 3,830,396 | 8/1974 | Jackson | 220/9 LG |

*Primary Examiner*—William F. O'Dea
*Assistant Examiner*—Ronald C. Capossela
*Attorney, Agent, or Firm*—Max L. Libman

[57] ABSTRACT

Large-scale cryogenic tanks such as for L.N.G. are supported on spaced-apart wooden bearer members which are part of the outer insulation. The weight of the loaded tank causes the floor of the tank to deflect on each side of the bearer members so that the loading increases to a degree that sometimes crushes the edges of the bearer members. Means are described for obviating this effect by inserts of resilient material extending inwardly from the sides of the bearer members, permitting sufficient deflection of the top edges of the bearer members to spread the load more uniformly over the bearer member.

7 Claims, 2 Drawing Figures

STORAGE CONTAINERS FOR LIQUEFIED GASES

Figure 1:
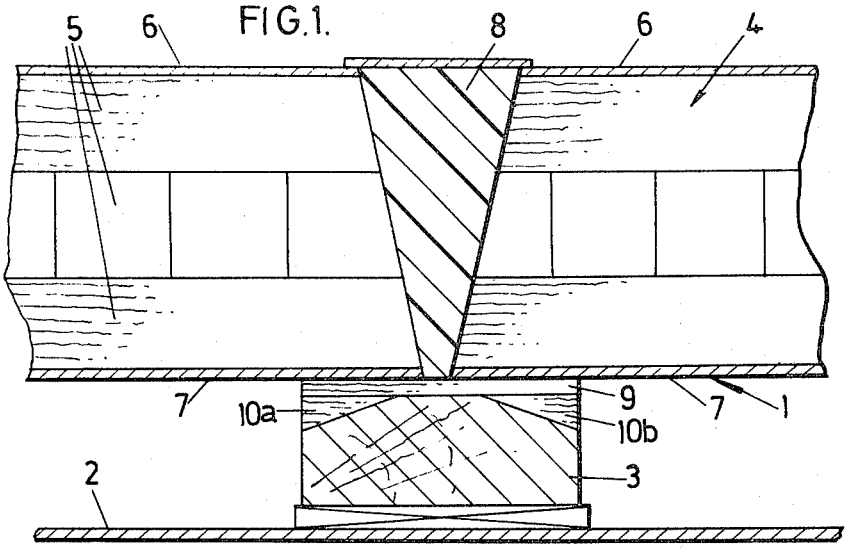

This invention relates to containers for the bulk storage or transport of liquids at temperatures greatly differing from ambient temperature. The invention is primarily intended for containers for very cold liquids, such as liquefied gases, e.g. natural gas, at near atmospheric pressure, but it may also be applicable to containers for housing warm liquids. By way of example, reference will be confined in the following to containers for cold liquids. Such containers are used, for example, in marine tankers, for the transport of liquefied gases.

Containers of the kind concerned, for the bulk storage or transport of liquids at temperatures greatly differing from ambient temperature, each comprises a tank surrounded and supported at least from below, by thermal insulation within an outer rigid shell. The present invention is concerned with the thermal insulation of such a container.

The containers may be arranged to house three distinct types of tank. In one type, the tank is a self-supporting tank, i.e., having sufficient structural strength to hold the liquid and withstand the hydrostatic pressures and inertia forces, without depending upon other means outside the tank for aid in supporting the walls of the tank against buckling. The tank is of a material e.g., metal, which is not subject to cold embrittlement at the temperature it is subjected to in use. The tank is insulated externally by thermal insulation which either directly encases the tank or lines the cargo hold of the tanker so as to define a containing space within which the tank is located, with or without a gap between its exterior surface and the interior surface of the insulation.

Another type of tank is known as an integrated container and comprises a housing of solid load-bearing thermal insulation lined with a thin and flexible fluid-tight membrane tank of sheet material which again is not subject to cold embrittlement at the temperatures encountered in use and which is not self-supporting but is supported against internal loads due to hydrostatic pressures and inertia forces, by the surrounding solid insulation. The insulation lines, and is itself supported by, the rigid cargo hold so that the insulation directly transmits to the cargo hold all the pressure exerted by the fluid upon the walls of the membrane tank.

The third type is generally referred to as the "semi-rigid type" and comprises a self-standing tank, i.e. a tank which will support its own weight only, the walls of which engage and are supported in use by solid insulation.

The present invention is applicable to containers including any of these types of tank.

In Applicant's British patent specification No. 1,203,496 a thermal insulation system is described in which less highly stressed parts are of rigid foamed plastic material, while more highly stressed parts are of a load-bearing material of higher strength, the two materials being joined together. The insulation layer supporting the bottom of the tank is described as being of the load-bearing material and in one embodiment comprises spaced timber ground strips constituting bearer members, on which are mounted relatively thick panels of the insulation material.

In a modification of such a thermal insulation system, described in Applicant's British patent specification No. 1,300,730, the supporting insulation layer for the tank comprises spaced bearer members of load bearing material and rigid foamed plastic material within the spaced and joined to the bearer members. A problem encountered is that of the edges of the bearer members crushing in use due to high loading.

An object of this invention is to alleviate this problem.

According to this invention, there is provided a container for the bulk storage or transport of liquids at temperatures greatly differing from ambient temperature and comprising a tank surrounded and supported at least from below by thermal insulation in an outer rigid shell, the insulation layer supporting the bottom of the tank including bearer members of load bearing material, wherein, inserts are provided extending inwardly from the edges or sides of said members, the inserts being of a resilient material.

Preferably, the compressibility of the inserts varies whereby, at any point toward an edge of a bearer member, the resilience provided will be sufficient to relieve the static and dynamic loading normally applied at that point by the tank and its contents.

Figure 2:
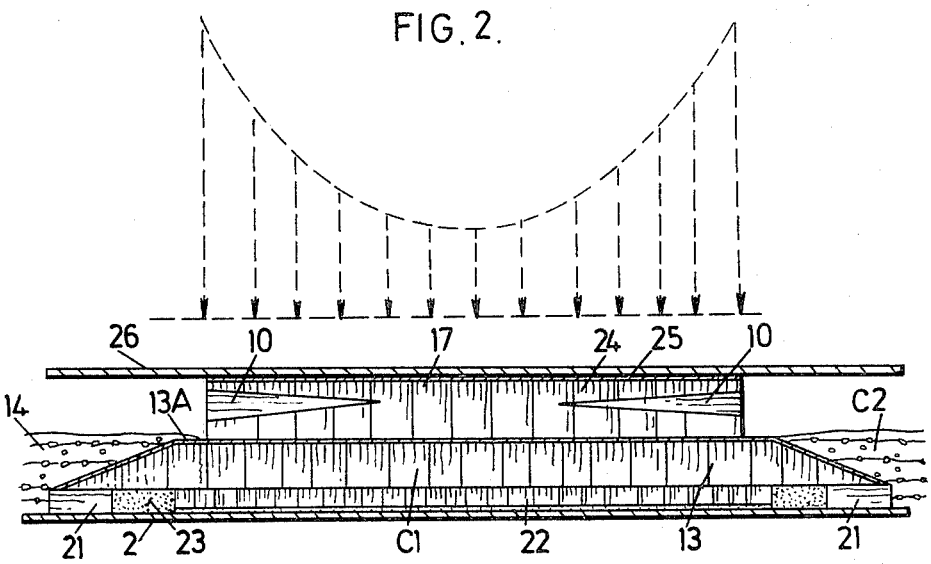

In order that the invention may be readily understood, two embodiments will now be described, by way of example, with reference to the accompanying drawings in which:

FIG. 1 is a fragmentary, sectional view of the first embodiment applied to a liquefied natural gas tanker, and FIG. 2 is a similar view of the second embodiment.

Referring to FIG. 1, the floor of a liquefied natural gas container 1 is provided with load-bearing insulation substantially as described in Applicant's British patent specification No. 1,203,496, particularly in respect of FIG. 1, or in British patent specification No. 1,226,035.

Thus, the floor 2 of a cargo hold defined by an inner hull of the tanker is provided with a number of elongated bearer members 3, in the form of timber ground strips, which are spaced at regular intervals over the area of said floor 2. Mounted upon the bearer members 3 are relatively thick panels 4 comprising a core 5 of balsa wood layers faced with plywood layers 6 and 7. The gaps between the panels 4 are sealed by a compressed plastic material 8, and the plywood layers 7 are attached to plywood caps 9 provided on the members 3 for example, by a suitable adhesive. In this way sealed joints are provided between adjacent plywood layers 7, whereby said layers constitute a secondary barrier for the liquid cargo. Further details of the panel construction and joints therebetween are described in Applicant's British patent specification No. 951,923.

In accordance with this invention, each or selected ones of the bearer member 3, which is preferably of hardwood, is provided with inserts of a resilient material, e.g. softwood or balsa wood, and the compressibility/resilience of the insert is varied over the width of the ground. It will be seen from FIG. 1, that this is achieved by providing two elongated wedge-like inserts **10*a*, 10*b* for each ground, rigidly located, e.g. by glueing, into tapered recesses let into each side of the ground beneath the plywood cap 9**.

Referring to FIG. 2, the invention is shown applied to bearer members substantially as described in Applicant's British patent specification No. 1,300,730. Thus, the bearer members 3 are provided in lines spaced from each other over the floor 2 of the cargo hold. As described in said patent specification particularly with reference to FIG. 4, each line, apart from that line at the center of the floor area, comprises spaced island panels. Each island panel is substantially as described with reference to FIG. 3 of said specification, and comprises timber ground strips 21 on which are mounted layers of balsa wood 13 faced with a liquid-tight plywood facing 13A. The spaces between the island panels are insulated with layers of rigid foamed plastic, referenced C 2, which is keyed to the facing 13A with the aid of layers of hessian or nylon netting 14, or similar material laid between the layers of plastics, the whole providing a secondary barrier for the liquid cargo. Further layers 22 and 24 of balsa are provided, respectively, below and above the layer 13, the layer 22 sited within the space left between the grounds 21 and keyed therein by a load-bearing mastic 23. The layer 24 has a plywood cap 25 on which the bottom 26 of a self-supporting or self-standing tank is located. The resilient inserts 10 in this embodiment extend around the perimeter of the islands and are glued into notch-shaped recesses let into said perimeter. Alternatively, they could be provided immediately beneath the plywood cap 25 in a manner similar to the first embodiment.

In view of the fact that the bearer members 3 of each embodiment provide local areas of support for the liquid gas tank, which tanks are being designed to hold a capacity of 25,000 cubic meters or of the order of 11,000 metric tons, there is a tendency for the floor of the tank to deflect on each side of said bearer members. This results in the loading applied to the bearer members varying over their faces and increasing sharply toward their edges, somewhat as shown by the dotted loading diagram 27 shown in FIG. 2. The loading at the edges is such that crushing can occur at these points and the invention provides for a resilience in the bearer members which is such as to eliminate the possibility of crushing. This resilience can be designed to vary in proportion to the loading to be taken at any point across the faces of said bearer members, whereby a proportional, counteracting "spring" is provided by the latter. To achieve this "spring" the compressibility of the inserts can be controlled by tapering the inserts as shown in the embodiments, by the use of a material such as p.v.c., the density of which is adjusted in dependence upon the loading to be taken, or by a combination of the two arrangements.

As indicated hereinbefore, a softwood or a resilient foam plastic material can be used for the insert. Another particularly suitable material is flat grain balsa wood of suitable density.

I claim:

1. A container for the large-scale storage of liquids at temperatures greatly differing from ambient temperature and comprising a tank surrounded and supported at least from below by thermal insulation in an outer rigid shell, the insulation layer supporting the bottom of the tank including bearer members of load bearing material capable of supporting the loaded weight of the tank, characterized in that inserts (10, 10*a*, 10*b*) are provided extending inwardly from the sides of said members (3), the inserts being of a resilient material characterized in that compressibility of the inserts varies whereby, at any point toward a side of a bearer member, the resilience provided is sufficient to relieve the static and dynamic loading normally applied at that point by the tank (26) and its contents due to deformation of the tank bottom where it extends beyond the side of a bearer member, and further characterized in that the inserts comprise two wedge-like pieces rigidly located in tapered recesses in the sides of said members, with the thick ends facing outwardly and the thin edges of said pieces toward each other, to provide increasing resilience toward the sides of the bearer members.

2. A container according to claim 1, further characterized in that the members are of a softwood with a plywood cap (9) and the recesses are located immediately beneath the plywood cap.

3. a. A container for large-scale storage of liquids at temperatures greatly different from ambient temperature and comprising b. a tank surrounded and supported at least from below by thermal insulation which includes spaced apart bearer members of load bearing material supporting the bottom of the tank at discrete areas, the bottom of the tank tending under load to deflect slightly at the edges of said discrete areas thus putting a concentrated stress on the outer sides and upper edges of said bearer members, c. means to relieve such stress comprising inserts of resilient material extending inwardly from the sides of said bearer members in the proximity of their upper edges, the resilience of said material being such as to relieve by compressive deformation the stress concentration at the upper edges of the bearer members.

4. The invention according to claim 3, wherein the compressibility of the inserts increases toward the sides of the bearer members to permit greater accommodation to load stress toward the edges of the bearer members where the stress is greatest, to thus distribute the stress more uniformly on the bearer member.

5. The invention according to claim 1, wherein the inserts are of a material formed with a variation in density which is adjusted in dependence upon the loading to be taken.

6. a. A container for large-scale storage of liquids at temperatures greatly different from ambient temperature and comprising b. a tank surrounded and supported at least from below by thermal insulation which includes spaced apart bearer members of load bearing material supporting the bottom of the tank at discrete areas, the bottom of the tank tending under load to deflect slightly at the edges of said discrete areas thus putting a concentrated stress on the outer sides and upper edges of said bearer members, c. means to relieve such stress comprising inserts of resilient material extending inwardly from the sides of said bearer members in the proximity of their upper edges, the resilience of said material being such as to relieve by compressive deformation the stress concentration at the upper edges of the bearer members, wherein the compressibility of the inserts increases toward the sides of the bearer members to permit greater accommodation to load stress toward the edges of the bearer members where the stress is greatest, to thus distribute the stress more uniformly on the bearer member, and wherein said inserts comprise wedge-like pieces rigidly located in tapered recesses in the sides of said members, with the thick ends facing outwardly and the thin edges of said pieces pointing inwardly, to provide increasing resilience toward the sides of the bearer members.

7. The invention according to claim 6, wherein the bearer members are of a softwood with a plywood cap, and the recesses are located immediately beneath the plywood cap.

* * * * *